United States Patent [19]

Jeschke et al.

[11] 4,242,959

[45] Jan. 6, 1981

[54] SHEET CARRIER

[75] Inventors: Willi Jeschke, Heidelberg; Peter W. Gögele, Rauenberg, both of Fed. Rep. of Germany

[73] Assignee: Heidelberger Druckmaschinen AG, Heidelberg, Fed. Rep. of Germany

[21] Appl. No.: 24,011

[22] Filed: Mar. 26, 1979

[30] Foreign Application Priority Data

Mar. 25, 1978 [DE] Fed. Rep. of Germany ..... 2813136

[51] Int. Cl.[3] ..... B41L 21/00; B41F 21/00

[52] U.S. Cl. ..... 101/420; 101/174

[58] Field of Search ..... 101/420, 421, 174, 246

[56] References Cited

FOREIGN PATENT DOCUMENTS

| | | | |
|---|---|---|---|
| 1179559 | 10/1964 | Fed. Rep. of Germany | 101/420 |
| 254748 | 12/1925 | Italy | 101/420 |
| 972487 | 10/1964 | United Kingdom | 101/420 |

*Primary Examiner*—J. Reed Fisher

*Attorney, Agent, or Firm*—Herbert L. Lerner

[57] ABSTRACT

Sheet carrier device disposed so as to be axially and radially adjustable on a transfer drum in a multicolor rotary printing machine and having axially shiftable carriers extending in circumferential direction on the casing of the drum, sheet carrier elements being interchangeably mounted on the carriers and displaceable in circumferential direction of the drum, the sheet carrier elements having supporting edges whereon a sheet being carried is supported when the carrier elements are in operating position. In a first embodiment the invention includes lines disposed circumferentially on the transfer drum and having a hook at least one end thereof for hooking the lines into the drum casing, the sheet carrying elements being formed with respective bores through which the sheet carrying elements are threaded on the lines, the sheet carrying elements having a square cross section concentric to the bores formed therein, respectively, and having the respective supporting edge thereof projecting from the square cross section, and a guide band mounted on the casing surface of the transfer drum and shiftable in axial direction thereof, the sheet carrying elements being disposed on the guide band so as to be pivotable through 90°. In a second embodiment the invention includes a guide rod axially mounted on the drum casing, stirrups forming a circumferentially extending circular segment, respectively, and being shiftable in axial direction on the guide rod, the sheet carrier elements being formed with a clamping opening by which the sheet carrier elements are mounted on the stirrups.

3 Claims, 6 Drawing Figures

SHEET CARRIER

The invention relates to a sheet carrying device disposed so as to be axially and radially adjustable on a transfer drum in a multicolor rotary printing machine and having axially displaceable carriers extending circumferentially on the drum casing, sheet carrying elements interchangeably mounted on the carriers and displaceable circumferentially, the sheet carrying elements having supporting edges whereon a sheet being carried is supported when the carrier elements are in operation position.

In multicolor rotary printing presses, the printed sheet is transported between the individual printing units by means of transfer drums. It is possible, in this connection, for the freshly printed side of the sheet to come to lie on the outer or casing surface of the transfer drum. This may cause the printed image to become spoiled due to the smudging of the wet ink.

A known construction of this general type (German Patent DE-PS No. 1 179 559) employs, as the carrier for the sheet carrying elements, a wire on which they are stuck. For this purpose, the sheet carrying elements are slotted longitudinally. The individual sheet carrying elements are shiftable on the wire in circumferential direction of the transfer drum, and the wire with the elements is moveable in axial direction of the drum. A disadvantage of this heretofore known construction is that it is complicated and time-consuming operation to adjust the sheet carrying elements at non-printed places on the sheet which is to be transferred. Thus, for each adjustment operation, it is necessary either to stick sheet carrying elements onto the wires or to remove them from the latter, so that the sheet carrying elements must be stored outside the machine and may even become lost. Furthermore, the wires have no lateral guidance and can, therefore, be moved laterally only with great difficulty. It is virtually necessary to move each element separately and to align it laterally. An object of the invention is, accordingly, to provide an economical adjustable sheet carrying device on transfer drums which does not require any additional storage space for the sheet carrying elements and which can easily be adjusted onto non-printed places on the sheet being transferred.

With the foregoing and other objects in view, there is provided, in accordance with the invention, a sheet carrier device disposed so as to be axially and radially adjustable on a transfer drum in a multicolor rotary printing machine and having axially shiftable carriers extending in circumferential direction on the casing of the drum, sheet carrier elements being interchangeably mounted on the carriers and displaceable in circumferential direction of the drum, the sheet carrier elements having supporting edges whereon a sheet being carried is supported when the carrier elements are in operating position, comprising lines disposed circumferentially on the transfer drum and having a hook at least at one end thereof for hooking the lines into the drum casing, the sheet carrying elements being formed with respective bores through which the sheet carrying elements are threaded on the lines, the sheet carrying elements having a square cross section concentric to the bores formed therein, respectively, and having the respective supporting edge thereof projecting from the square cross section, and a guide band mounted on the casing surface of the transfer drum and shiftable in axial direction thereof, the sheet carrying elements being disposed on the guide band so as to be pivotable through 90°. This sheet carrier device according to the invention is simple and reliable in operation and can easily be adjusted for all types of printing work encountered in practice. Due to the square cross-section of the sheet carrying elements means, they can easily be pivoted out of the operating position thereof into the rest position thereof.

In accordance with another feature of the invention, the guide band is formed with a recess at the outer periphery thereof, the recess having a width corresponding to the length of an edge of the square cross section of the sheet carrying elements, the square cross section of the sheet carrying elements being latchable into a respective recess when the sheet carrying elements are pivoted through 90°. Precise lateral guidance for the sheet carrying elements is thereby provided. It is not necessary to re-adjust the individual elements in the case of axial displacement, because the sheet carrying elements latch both in the operating position as well as in the rest position thereof.

In accordance with a further embodiment of the invention, there is provided a sheet carrier device disposed so as to be radially and axially adjustable on a transfer drum having axially shiftable carriers extending in circumferential direction on the casing of the drum, sheet carrier elements being interchangeably mounted on the carriers and displaceable in circumferential direction of the drum, the sheet carrier elements having supporting edges whereon a sheet being carried is supported when the carrier elements are in operating position, comprising a guide rod axially mounted on the drum casing, stirrups forming a circumferentially extending circular segment, respectively, and being shiftable in axial direction on the guide rod, the sheet carrier elements being formed with a clamping opening by which the sheet carrier elements are mounted on the stirrups. This slightly different construction provides the same advantages described hereinbefore with the difference that, in place of the line or cord, use is made of a rigid stirrup which, owing to its construction, offers greater strength in the case of heavy printing work.

In accordance with a concomitant feature of the invention, the sheet carrying elements are formed of spring steel and define the clamping openings, both the clamping opening and the cross section of the stirrups having approximately matching square cross sections.

Other features which are considered as characteristic for the invention are set forth in the appended claims.

Although the invention is illustrated and described herein as embodied in a sheet carrier, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
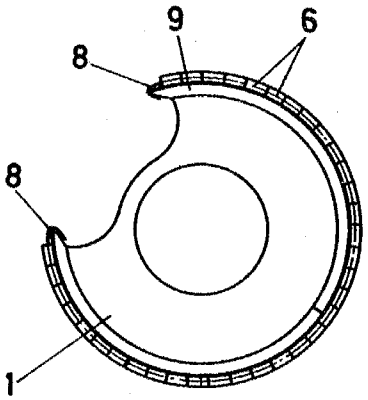
FIG. 2 is an end view of the transfer drum of FIG. 1.
Figure 1:
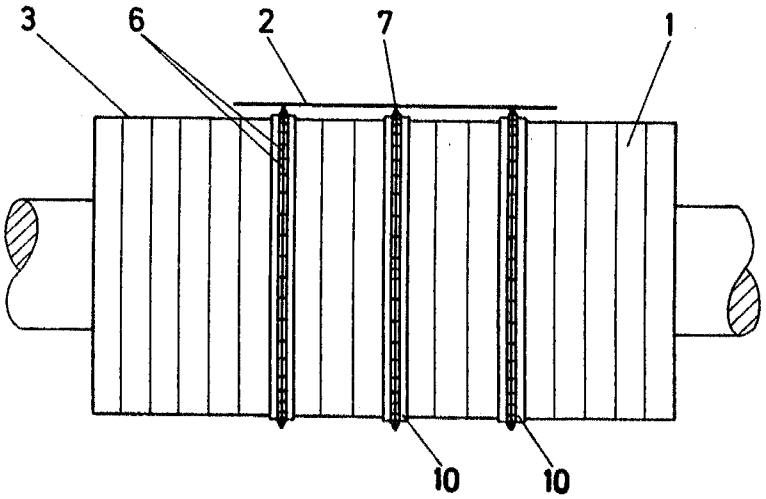
FIG. 1 is a longitudinal axial view of a transfer drum.
Figure 3:
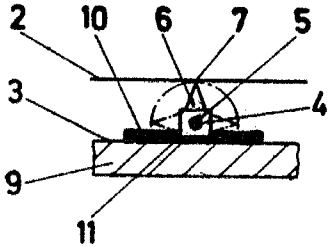
FIG. 3 is an enlarged fragmentary cross-sectional view of FIG. 1 showing a sheet carrying element thereof.

Referring now to the drawing and first, particularly to FIGS. 1 to 3 there is shown a transfer drum 1 provided with a conventional non-illustrated gripper device by means of which it takes over a sheet 2 for transport from preceding non-illustrated grippers and transports it to the next non-illustrated grippers of a transfer drum or of a printing cylinder. The sheet 2 which may be of varying length and width rests on sheet carrying elements 6 disposed on the drum surface 3.

On the drum surface 3, there are stretched, in circumferential direction thereof, spring-elastic or resilient lines or strands 4 onto which are threaded individual sheet carrying elements 6 which are formed with a bore 5 (FIGS. 1 to 3). The sheet carrying elements 6 are provided with a supporting edge 7 on which the sheet 2 deposits. As is apparent from FIG. 3, the sheet carrying element 6 can be pivoted out of a middle perpendicular working position thereof into a rest position on either side thereof as shown in phantom. Due to the square cross-section of the sheet carrying element, concentric to the bore 5, the sheet carrying element rests in every position.

In the view of the first embodiment as provided in FIG. 2, the ends of each line or cord 4 has a hook 8 by means of which the cord 4 is hooked into the drum casing 9, as shown. Furthermore, the sheet carrying elements 6 are disposed on a guide band 10 (FIGS. 1 and 3) which, in turn, is located on the outer casing surface 3 of the transfer drum 1 and is displaceable or shiftable thereon in axial direction of the latter. The guide band 10 is held fast in the respective position thereof on the drum surface by the cord or line 4.

As can be seen from FIG. 3 the other peripheral surface of the guide band 10 is formed with a recess 11, the width of which corresponds to an edge of the square cross-section of the sheet carrying elements 6, with the result that the square cross-section of the sheet carrying elements 6 latches or fits into the recess 11 when the sheet carrying elements 6 are pivoted through 90°.

Figure 5:
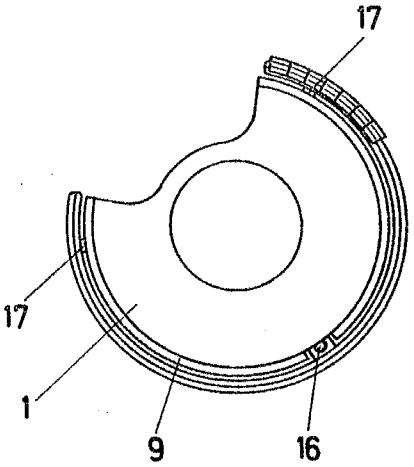
FIG. 5 is an end view of the transfer drum with stirrup.
Figure 4:
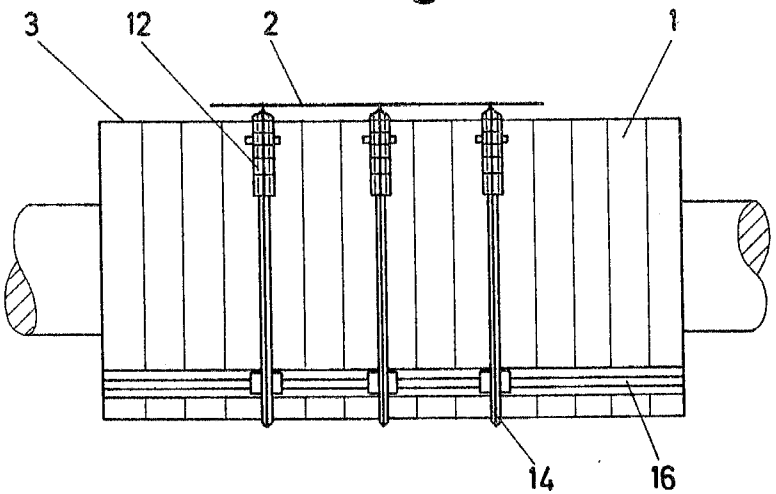
FIG. 4 is a view similar to that of FIG. 1 of another embodiment of the transfer drum with a stirrup.
Figure 6:
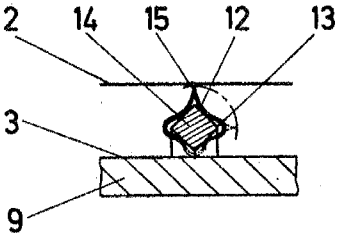
FIG. 6 is a view similar to that of FIG. 3 of a sheet carrying element with stirrup of the embodiment of FIG. 4.

In a slightly different version or embodiment of the invention, (FIGS. 4 to 6), the sheet carrying element 12 is formed of spring steel and defines an approximately square opening 13. By means of this opening 13, the sheet carrying element 12 is stuck onto a stirrup or yoke 14 of square cross-section and likewise has a supporting edge 15 for supporting the sheet 2 thereon. The stirrup 14 is mounted on a guide rod 16 secured in the transfer drum 1 and is displaceable in axial direction of the guide rod. Furthermore, it is supported on the drum casing 9 by means of supports 17.

There are claimed:

1. Sheet carrier device disposed so as to be axially adjustable on a transfer drum in a multicolor rotary printing machine and having axially shiftable carriers extending in circumferential direction on the casing of the drum, sheet carrier elements being interchangeably mounted on the carriers and adjustably displaceable in circumferential direction of the drum, the sheet carrier elements having supporting edges whereon a sheet being carried is supportable in a given working position of the sheet carrier elements, comprising lines disposed circumferentially on the transfer drum and having a hook at leastat one end thereof for hooking said lines into the drum casing, the sheet carrier elements being formed with respective bores through which the sheet carrier elements are threaded on said lines, said sheet carrier elements having a square cross section concentric to said bores formed therein, respectively, and having the respective supporting edge thereof projecting from said square cross section, said carriers, respectively, comprising a guide band mounted on the casing surface of the transfer drum and shiftable in axial direction thereof, said sheet carrier elements being disposed on said guide band so as to be pivotable through 90° into and out of said given working position thereof.

2. Sheet carrier device according to claim 1 wherein said guide band is formed with a recess at the outer periphery thereof, said recess having a width corresponding to the length of an edge of said square cross section of said sheet carrier elements, said square cross section of said sheet carrier elements being latchable into a respective recess when said sheet carrier elements are pivoted through 90°.

3. Sheet carrier device disposed so as to be axially adjustable on a transfer drum having axially shiftable carriers extending in circumferential direction on the casing of the drum, sheet carrier elements being interchangeably mounted on the carriers and adjustably displaceable in circumferential direction of the drum, the sheet carrier elements having supporting edges whereon a sheet being carried is supportable in a given working position of the sheet carrier elements, comprising guide means axially disposed on the drum casing, said carriers comprising stirrups each having a square cross section and forming a circumferentially extending circular segment, respectively, said stirrups being shiftable in axial direction on said guide means, each of said sheet carrier elements being formed of spring steel and defining a clamping opening of square cross section approximately matching that of said stirrups by which said sheet carrier elements are mounted on said stirrups.

* * * * *